United States Patent [19]

Meijer et al.

[11] Patent Number: 4,532,855

[45] Date of Patent: Aug. 6, 1985

[54] TWO-PART DRIVE SHAFT FOR THERMAL ENGINE

[75] Inventors: Roelf J. Meijer; Benjamine Ziph; Ted M. Godett, all of Ann Arbor, Mich.

[73] Assignee: Stirling Thermal Motors, Inc., Ann Arbor, Mich.

[21] Appl. No.: 596,222

[22] Filed: Apr. 4, 1984

[51] Int. Cl.[3] ..... F01B 3/02; F01B 13/04; F01B 29/10

[52] U.S. Cl. ..... 92/71; 92/147; 91/499; 60/525

[58] Field of Search ..... 91/472, 473, 475, 499, 91/503–507; 92/12.2, 71, 147; 62/6; 60/516, 517, 518, 525; 417/269; 74/60, 839

[56] References Cited

U.S. PATENT DOCUMENTS

| | | | |
|---|---|---|---|
| 2,459,786 | 1/1949 | Beaman et al. | 91/499 |
| 3,303,794 | 2/1967 | Hagemann | 91/507 |
| 3,538,706 | 11/1970 | Toepel | 417/269 X |
| 4,030,404 | 6/1977 | Meijer | 417/269 X |
| 4,223,593 | 9/1980 | Kitayama | 91/473 X |
| 4,235,116 | 11/1980 | Meijer et al. | 74/60 |
| 4,282,716 | 8/1981 | Momose et al. | 62/6 |
| 4,375,749 | 3/1983 | Ishizaki | 62/6 |
| 4,454,779 | 6/1984 | Vos | 92/12.2 |

FOREIGN PATENT DOCUMENTS

| | | | |
|---|---|---|---|
| 110837 | 7/1983 | Japan | 60/525 |
| 2064673 | 6/1981 | United Kingdom | 91/499 |

*Primary Examiner*—William L. Freeh
*Assistant Examiner*—Paul F. Neils
*Attorney, Agent, or Firm*—Stephenson and Boller

[57] ABSTRACT

An improved construction for a thermal engine, particularly a Stirling engine, comprising a two-part drive shaft. One part of the drive shaft contains the swashplate mechanism and is journaled on the engine housing so that the component of force acting on the swashplate which induces bending of the drive shaft is reacted on the housing by the journaling of the one part of the shaft. The second shaft part is separate from but operatively coupled with the first-mentioned shaft part and has its own journal mounting on the housing. The operative coupling in the disclosed embodiment is by means of a spline connection between the two shaft parts which are in coaxial alignment. The second shaft part is journaled on a housing part which is separable from other parts of the housing on which the first shaft part is journaled. A pressure seal between the rotating drive shaft and the housing is provided between the second shaft part and its housing part, and in this way the seal is substantially isolated from the effect of bending loads imparted to the drive shaft by the swashplate mechanism.

10 Claims, 3 Drawing Figures

TWO-PART DRIVE SHAFT FOR THERMAL ENGINE

BACKGROUND AND SUMMARY OF THE INVENTION

This invention relates generally to thermal engines and is particularly concerned with an improved construction for such an engine, particularly a Stirling engine.

In an example of a Stirling engine a swashplate is journaled for rotation on a housing. The swashplate is driven by crossheads connected to reciprocating pistons and the swashplate in turn operates a drive shaft via which mechanical power is delivered to any utilization mechanism coupled to the engine. The construction of the drive mechanism is such that forces which act on the swashplate are at locations spaced from the axis of rotation of the swashplate. It has been observed that the interaction of the drive mechanism with the swashplate is such that each force component acting on the swashplate is resolved into a component producing rotation and a component which tends to impart bending to the drive shaft.

In the example, the Stirling engine includes a pressure hull cooperatively associated with the engine housing to define an interior space which is subject to pressures different from those on the exterior of the pressure hull, i.e. on the outside of the engine. The drive shaft passes through both the housing and the pressure hull so that power can be delivered to whatever utilization mechanism is connected to the engine.

Stirling Thermal Motors, Inc., assignee of the present invention, has been involved in development work on such engines and has heretofore created an improved mounting and sealing of the pressure hull on the engine housing. The present invention is directed to a further improvement for enhancing the effectiveness of the seal between the drive shaft and the housing and which also incorporates, in the peferred embodiment, the benefits of the previous improvement in construction of the pressure hull.

More specifically the present invention arises through the recognition that the bending of the drive shaft which is caused by one of the components of force applied to the swashplate can impair the effectiveness of the pressure seal which is required between the drive shaft and the housing. The present invention responds to this observation by providing a novel and unique construction wherein the drive shaft is constructed of two separate drive shaft members operatively coupled together. One of these members is coupled to the swashplate and is so journaled on the housing that the bending moment imparted to the drive shaft by the swashplate is reacted substantially entirely via this first shaft member and its journaling on the housing. The second shaft member is also journaled on the housing, and the pressure seal between the drive shaft and the housing is provided between this second shaft member and the housing. The point of operative coupling between the two shaft members is between the pressure seal and the swashplate. The illustrated form of operative coupling in the disclosed example is a spline connection between the two shaft members. With this construction the bending loads are not transmitted through to the second shaft member so that the pressure seal is not subjected to any significant side forces. Hence, effectiveness of this seal is significantly improved. The construction provides further advantages of having convenient assembly and disassembly, and a further pressure seal between the pressure hull and the housing is also unaffected by the drive shaft bending.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
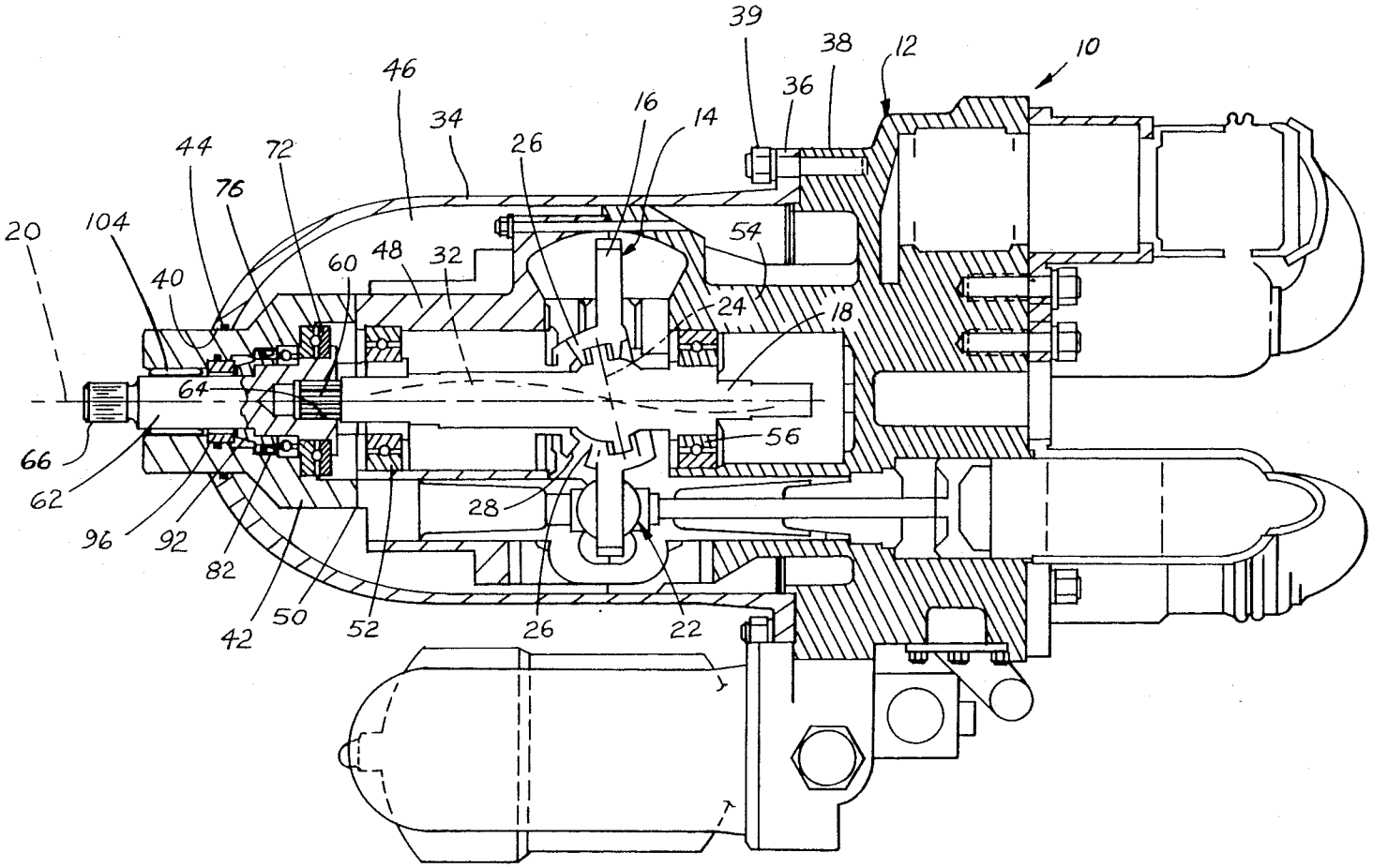
FIG. 1 is a longitudinal cross sectional view through a preferred exemplary embodiment of a thermal engine in accordance with principles of the present invention.

FIG. 1 illustrates a representative thermal engine 10 embodying principles of the present invention. Engine 10 comprises a housing structure designated by the general reference numeral 12. Housing structure 12 contains an operating mechanism, designated by the general reference numeral 14, for converting the reciprocating motion of pistons into rotation of a drive shaft. The mechanism 14 includes a swashplate 16 on a shaft 18 journaled on housing structure 12 for rotation about an axis 20. Shaft 18 forms a part of the engine drive shaft and in accordance with principles of the invention to be hereinafter explained in detail, there is also a second part of the drive shaft which is operatively coupled with shaft 18.

Energy is imparted to swashplate 16 by pistons and connecting rods which act upon the swashplate at locations spaced radially outwardly of axis 20, for example, at the locations where the sliders 22 are positioned in FIG. 1. The swashplate 16 is mounted on shaft 18 so as to rotate about axis 20. The crossheads which slidably connect the piston connecting rods to the swashplate 16 are equipped with sliders 22 which cause reciprocation of the pistons to rotate the swashplate 16 and thus the shaft 18.

The gears 26 and 28 are part of a mechanism which effects relative rotation between swashplate 16 and the main shaft 18 so as to change the angle of the swashplate 16 thereby changing the piston stroke and thence the engine power.

Each force which acts upon the swashplate to produce the concurrent rotation and oscillation is resolved into two force components. One of these forces cause the rotation of swashplate 16 about axis 20. The end result of the other force is the creation of a bending moment in the drive shaft which gives rise to bending. Such bending is exemplified in an exaggerated fashion by the broken line 32 in FIG. 1. The bending moment has been recognized by applicants in previous engines as having an effect on the pressure sealing of the drive shaft to the housing. As will be explained, applicant's invention eliminates this effect by isolating the pressure seal from the induced bending moment, and that is why FIG. 1 shows the bending as occurring only in shaft 18.

The illustrated engine further comprises a pressure hull 34 which has a cooperative association with housing structure 12. As can be seen in FIG. 1 pressure hull 34 is fitted over one axial end of the engine and includes a distal flange 36 which is disposed against and attached and sealed to a mating flange 38 of housing structure 12. Removable fasteners 39 are used for the attachment.

Housing structure 12 extends to the left-hand axial end of the engine as viewed in FIG. 1, and pressure hull 34 is provided with a hemispherically shaped left-hand axial end containing a circular aperture 40 which fits over a housing part which is designated by the reference numeral 42. Housing part 42 has a circular cross section, and an O-ring seal 44 is provided between aperture 40 and housing part 42 to provide a pressure seal therebetween. The cooperative association of pressure hull 34 with housing 12 defines an interior space 46 which is subjected to pressures different from those which may exist on the exterior of the engine. Hence, sealing of the engine is important to avoid adverse effects due to loss of pressure. As can be seen from consideration of FIG. 1, housing structure 12 is fabricated as a number of individual housing parts assembled together including housing part 42. Housing part 42 attaches to another housing part 48 at the location indicated by the reference numeral 50.

Housing part 48 provides for the through-passage of the left-hand end of shaft 18 as viewed in FIG. 1, and it serves to journal the left-hand end of the shaft by means of a bearing assembly 52. The portion of shaft 18 on the opposite side of the swashplate is journaled on another housing part 54 by means of a bearing assembly 56.

With this construction and arrangement, shaft 18 is journaled on the housing such that the bending induced by the swashplate is reacted by bearing assemblies 52 and 56 on the respective housing parts 48 and 54.

Shaft 18 terminates in an external spline 60 at its left hand end. As can be seen this still lies within the engine, and in order to provide an external power takeoff point for the mechanical power output of the engine, a second shaft 62 is journaled on housing part 42 and is provided with an internal spline 64 at its right hand end which meshes with spline 60. In this way, the drive shaft of the engine may be considered as comprising a two-part construction, one part being shaft 18 on which swashplate 16 is supported and the other part being shaft 62 which is coupled to shaft 18 and extends through housing 12 to provide the power takeoff point 66 on the exterior of the engine.

Figure 2:
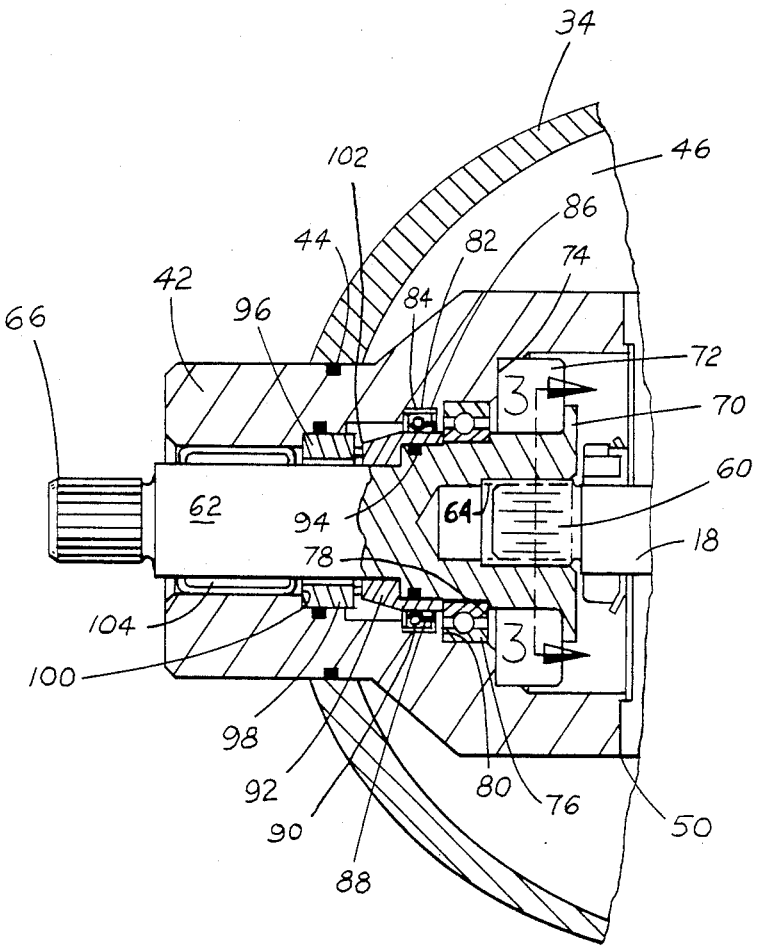
FIG. 2 is an enlarged fragmentary view of the left-hand end portion of the engine of FIG. 1.
Figure 3:
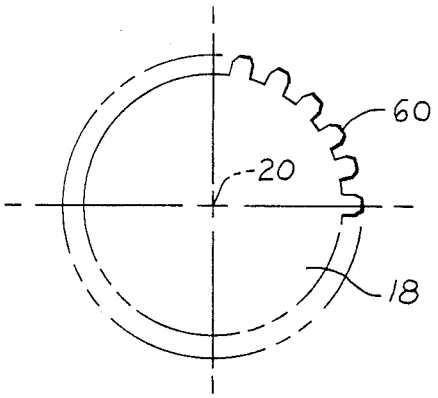
FIG. 3 is a fragmentary enlarged cross sectional view as taken in the direction of arrows 3—3 in FIG. 2.

FIGS. 2 and 3 illustrate greater detail of the construction in the vicinity of shaft 62. Housing part 42 comprises a throughbore having a number of shoulders which face toward the interior of the engine. Shaft 62 is also provided with several shoulders.

A shoulder 70 at the far right hand end of shaft 62 is disposed against an axial thrust bearing assembly 72 one of whose races is received within a shoulder 74 of housing part 42. A radial bearing assembly 76 journals shaft 62, with the inner race fitting over the shaft and against a shoulder 78. The outer race of bearing assembly 76 fits within a shoulder 80.

The pressure seal for sealing between the drive shaft and housing acts upon shaft 62. It comprises an oil seal assembly designated by the general reference numeral 82 which is received within a shoulder 84 of housing part 42. The seal assembly comprises a retainer part 86 fitting within shoulder 84, and a circular, annular lip seal 88, a peripheral portion of which is secured to the retainer part. The seal 88 contacts the shaft and is held in sealing contact with the shaft by means of a garter spring 90. The seal has a sealing contact with an annular element 92 which is fitted over, secured to, and forms a part of shaft 62. Sealing between the I.D. of annular element 92 and the O.D. of shaft 62 is accomplished by means of an O-ring seal 94.

A main seal 96 is provided by a member 98 which is received within a shoulder 100 of housing part 42 with a circular projection confronting a flat face 102 at the end of member 92. The seal 96 is maintained under oil at all times by the seal 82.

A set of needle bearings 104 is provided at the end of the housing at a position adjacent main seal 96 for journaling shaft 62.

The power takeoff point 66 is located just beyond the needle bearings 104. The seal 44 isolates housing part 42 from hull 34 and the pressure forces thereon because it allows slight movement between part 42 and hull 34.

With this arrangement and construction shaft 62 is suitably journaled on housing part 42 for rotation about axis 20 and to react axial thrust loads by means of thrust bearing assembly 72. It will be appreciated of course that the two sets of bearings 72 and 76 which perform respective axial and radial functions could be replaced by a single set of tapered roller bearings which would perform both radial and axial functions.

The construction is also such that the joint between pressure hull 34 and housing part 42 (i.e. at 0-ring 44) eliminates the effect of pressure induced forces on the hull 34 on the seal housing 42 and hence the design of the seal 96 can be predicated essentially on pressure differentials on the seal itself. The construction is also such that the pressure hull can be removed and installed without having to disassemble any of the rotating parts. Fasteners 39 used to secure flange 36 to housing 12 can be removed, and pressure hull 34 axially displaced to the left as viewed in FIG. 1 to separate it from the rest of the engine. Installation can be done in the opposite fashion.

With the pressure hull removed, it is also possible to assemble and disassemble housing part 42 and the second drive shaft member 62 as a unit from the rest of the engine. By removing housing part 42 the spline connection between the two drive shaft members automatically separates in the process with shaft 62 axially sliding off shaft 18.

Because the pressure hull is separable from the engine without affecting the ability to rotate the drive shaft, it is possible for the moving parts of the assembly to be checked without the engine actually being operated. In other words, the rotating components can be tested by driving them with an external means such as an electric motor. This allows for inspection of alignment of the drive system, testing of integral lubrication system, and observing swashplate angle changes.

When the pressure hull is reassembled to the housing, the only action on seal 44 between the housing and the pressure hull is that of the pressure, and therefore the engine possesses the advantage of eliminating any effect of the rotation of the drive shaft on this particular seal. The construction of the housing and drive shaft assembly is such that the pressure seal 96 between the rotating shaft and the interior of the engine is effective to prevent loss of pressure while being essentially isolated from the bending loads to which the drive shaft is subjected by virtue of the swashplate operation. In this way the engine provides an enhanced sealing of the rotating shaft to the housing.

The spline connection between the two shaft parts is advantageous because it can be manufactured with known procedures and it can efficiently transmit power, yet this connection is susceptible to certain slight misalignments between the two shaft parts and can contribute to isolating the second shaft part and pressure seal from the swashplate-induced bending on the first shaft part.

While a preferred embodiment of the invention has been disclosed, it will be appreciated that principles are applicable to other embodiments.

What is claimed is:

1. In a thermal engine in which thermal energy is converted to mechanical energy of rotation, said engine comprising housing structure, a drive mechanism cooperatively associated with said housing structure including a variable swashplate mechanism journaled on said housing structure for rotation about an axis to deliver mechanical energy of rotation via a drive shaft providing a power takeoff point on the exterior of the engine for delivery of engine power to any utilization mechanism which may be operatively coupled with the engine, and pressure sealing means for sealing said drive shaft with respect to said housing structure to prevent loss of internal pressure from the engine between said drive shaft and said housing structure, the improvement which comprises journal means for journaling said variable swashplate mechanism on said housing structure such that said housing structure reacts, via said journal means, bending loads developed by the operation of said swashplate mechanism, and a further shaft separate from the journaled swashplate mechanism but operatively coupled with said swashplate mechanism and disposed between said power takeoff point and said swashplate mechanism, further journal means journaling said further shaft on said housing structure, said further journal means and said first-mentioned journal means being independent of each other, whereby said further shaft is substantially isolated from such bending loads, and wherein said pressure sealing means has an operative association with said further shaft so as to also be substantially isolated from such bending loads and said engine including pressure hull structure having a cooperative association with said housing structure whereby an interior space is cooperatively defined by said pressure hull structure and said housing structure and which is subjected to pressure different from that on the exterior of the engine, said pressure hull structure being cooperatively associated with said housing structure such that said housing structure passes through and is sealed relative to an aperture in said pressure hull structure which aperture is coaxial with said further shaft.

2. In a thermal engine in which thermal energy is converted into mechanical energy of rotation, said engine comprising housing structure, a drive mechanism cooperatively associated with said housing structure including a variable swashplate mechanism journaled on said housing structure for rotation about an axis to deliver mechanical energy of rotation via a drive shaft having a power takeoff point on the exterior of the engine for delivery of engine power to any utilization mechanism which may be operatively coupled with the engine, and pressure sealing means for sealing said drive shaft with respect to said housing structure to prevent loss of internal pressure from the engine between said drive shaft and said housing structure, the improvement which comprises said drive shaft comprising two separate shaft members for transmitting power from said swashplate mechanism to said power takeoff point, and an operative coupling between said two members for transmitting power from one shaft member to the other shaft member, journal means to journal said one shaft member on said housing structure so that said housing structure reacts, via said one shaft member and said journal means, bending loads imparted to said drive shaft by said swashplate mechanism, said operative coupling between said two members being between said journal means and said power takeoff point so that bending loads reacted by said housing structure via said one shaft member and said journal means are substantially prevented from being transmitted to said other shaft member, said operative coupling being disposed between said pressure sealing means and said journal means whereby said pressure sealing means is substantially unaffected by such bending loads imparted to said drive shaft, further journal means journaling said other shaft member on said housing structure, said further journal means and said first-mentioned journal means being independent of each other and said engine including pressure hull structure having a cooperative association with said housing structure whereby an interior space is cooperatively defined by said pressure hull structure and said housing structure and which is subjected to pressure different from that on the exterior of the engine, said pressure hull structure being cooperatively associated with said housing structure such that said housing structure passes through and is sealed relative to an aperture in said pressure hull structure which aperture is coaxial with said another shaft member.

3. The improvement set forth in claim 2 in which said two shaft members are arranged in straight coaxial alignment with each other.

4. The improvement set forth in claim 2 in which said further journal means comprises a radial and axial journal means for said other shaft member on said housing structure, said last-named journal means being disposed between said pressure sealing means and said operative coupling.

5. The improvement set forth in claim 2 in which said operative coupling between said two shaft members comprises a spline connection.

6. The improvement set forth in claim 5 in which said spline connection comprises an external spline on said one shaft member and an internal spline on said other shaft member.

7. In a thermal engine in which thermal energy is converted into mechanical energy of rotation, said engine comprising housing structure, a drive mechanism cooperatively associated with said housing structure including a variable swashplate mechanism journaled on said housing structure for rotation about an axis to deliver mechanical energy of rotation via a drive shaft having a power takeoff point on the exterior of the engine for delivery of engine power to any utilization mechanism which may be operatively coupled with the engine, and pressure sealing means for sealing said drive shaft with respect to said housing structure to prevent loss of internal pressure from the engine between said drive shaft and said housing structure, the improvement which comprises said drive shaft comprising two separate shaft members for transmitting power from said swashplate mechanism to said power takeoff point, and an operative coupling between said two members for transmitting power from one shaft member to the other shaft member, journal means to journal said one shaft member on said housing structure so that said housing structure reacts, via said one shaft member and said journal means, bending loads imparted to said drive shaft by said swashplate mechanism, said operative coupling between said two members being between said journal means and said power takeoff point so that bending loads reacted by said housing structure via said one shaft member and said journal means are substantially prevented from being transmitted to said other shaft member, and said operative coupling being disposed between said pressure sealing means and said journal means whereby said pressure sealing means is substantially unaffected by such bending loads imparted to said drive shaft; and in which said housing structure comprises separable housing parts, journal means journaling said one shaft member on one housing part and further journal means journaling said other shaft member on another housing part, said one and said another housing parts being separably mounted with respect to each other.

8. The improvement set forth in claim 7 in which said other shaft member and said another housing part are so constructed and arranged as to be removable as a unit from the engine when said another housing part is separated from said one housing part.

9. The improvement set forth in claim 7 further including a pressure hull having a cooperative association with said housing structure whereby an interior space is cooperatively defined by said pressure hull and said housing structure and which is subjected to pressure different from that on the exterior of the engine, said pressure hull being cooperatively associated with said housing structure such that said another housing part passes through an aperture in said pressure hull, which aperture is coaxial with said another shaft member, and including sealing means disposed between said aperture and said another housing part to seal off said interior space between said aperture and said another housing part.

10. In a thermal engine in which thermal energy is converted into mechanical energy of rotation, said engine comprising housing structure, a drive mechanism cooperatively associated with said housing structure including a variable swashplate mechanism journaled on said housing structure for rotation about an axis to deliver mechanical energy of rotation via a drive shaft having a power takeoff point on the exterior of the engine for delivery of engine power to any utilization mechanism which may be operatively coupled with the engine, and pressure sealing means for sealing said drive shaft with respect to said housing structure to prevent loss of internal pressure from the engine between said drive shaft and said housing structure, the improvement which comprises said drive shaft comprising two separate shaft members for transmitting power from said swashplate mechanism to said power takeoff point, and an operative coupling between said two members for transmitting power from one shaft member to the other shaft member, journal means to journal said one shaft member on said housing structure so that said housing structure reacts, via said one shaft member and said journal means, bending loads imparted to said drive shaft by said swashplate mechanism, said operative coupling between said two members being between said journal means and said power takeoff point so that bending loads reacted by said housing structure via said one shaft member and said journal means are substantially prevented from being transmitted to said other shaft member, and said operative coupling being disposed between said pressure sealing means and said journal means whereby said pressure sealing means is substantially unaffected by such bending loads imparted to said drive shaft, and further including a pressure hull having a cooperative association with said housing structure to define an interior space which is subjected to pressure different from that on the exterior of the engine, and said pressure hull having a cooperative association with said housing structure such that a portion of said housing structure passes through an aperture in said pressure hull, which aperture is coaxial with the axis of said drive shaft, and including sealing means disposed between said aperture and said housing structure to seal off said interior space between said aperture and said housing structure.

* * * * *